United States Patent [19]

Takiguchi

[11] Patent Number: 4,713,015

[45] Date of Patent: Dec. 15, 1987

[54] CONNECTING STRUCTURE FOR HIGH VOLTAGE RESISTANCE WIRES

[75] Inventor: Isao Takiguchi, Gotenba, Japan

[73] Assignee: Yazaki Corporation, Japan

[21] Appl. No.: 884,605

[22] Filed: Jul. 11, 1986

[30] Foreign Application Priority Data

Jul. 12, 1985 [JP] Japan ..... 60-105491

[51] Int. Cl.[4] ..... H01R 13/516

[52] U.S. Cl. ..... 439/125; 439/278

[58] Field of Search ..... 339/26, 143 S, 149 S, 339/213 R S, 136 C

[56] References Cited

U.S. PATENT DOCUMENTS

| | | | |
|---|---|---|---|
| 2,745,075 | 5/1956 | Simpkins et al. . | |
| 3,076,113 | 1/1963 | Candelise | 339/26 X |
| 3,184,701 | 5/1965 | Ellis . | |
| 3,212,044 | 10/1965 | Cloud, Jr. . | |
| 3,266,008 | 8/1966 | Elliott . | |
| 3,404,368 | 10/1968 | Roberts et al. . | |
| 4,443,047 | 4/1984 | Hofmann | 339/26 |
| 4,497,532 | 2/1985 | Bezusko et al. | 339/26 X |

FOREIGN PATENT DOCUMENTS

| | | |
|---|---|---|
| 47-41713 | 10/1972 | Japan . |
| 60-63887 | 4/1985 | Japan . |

*Primary Examiner*—Gil Weidenfeld
*Assistant Examiner*—Steven C. Bishop
*Attorney, Agent, or Firm*—Wigman & Cohen

[57] ABSTRACT

A connecting structure for the high voltage resistance wire used to feed a high voltage to, for instance, the ignition plug of an engine, has a high voltage resistance wire for noise suppression which has on one end a connecting terminal which can be fitted to a high voltage terminal that has a cylindrical insulator on its circumference. An insulating soft elastic cap is attached to the high voltage resistance wire and surrounds the connecting terminal, which is fitted to the high voltage terminal. The cap also is fitted to the cylindrical insulator of the high voltage terminal. A rigid holder is inserted on the outside of the elastic cap, and is fitted closely to the outer periphery of the connecting portion of the elastic cap and the cylindrical insulator.

15 Claims, 6 Drawing Figures

CONNECTING STRUCTURE FOR HIGH VOLTAGE RESISTANCE WIRES

BACKGROUND OF THE INVENTION

1. Field of the Invention

The present invention relates to a connecting structure for high voltage resistance wire which is suited for connecting a high voltage resistance wire for suppressing noise, in particular to a wire connecting structure which is suited for feeding a high voltage to the ignition plug of an engine or the like.

2. Description of Prior Art

Conventionally, for feeding a high voltage to the ignition plug of an engine or the like, a high voltage resistance wire for suppressing noise is provided with a connector to the high voltage terminal. A rubber cap is then adhered to the connecting portion, covering and hermetically sealing the connector to the high voltage terminal. An example of such a prior structure is shown in FIG. 1. In the figure, 1 is an ignition terminal plug, 2 is an ignition plug insulator, 3 is a high voltage resistance wire for suppressing noise, 4 is a connector terminal which is secured to one end of the high voltage resistance wire 3, and 5 is a plug cap made of rubber which is fitted to the circumference of the end of the high voltage resistance wire 3 so as to enclose the terminal therein. The plug cap 5 makes a close contact with the exterior of the ignition plug insulator 2 to prevent the attachment of moisture or contaminants to the surface of the insulator, thereby suppressing the leakage of electricity at high voltage or generation of short-circuiting by flashing.

In such a conventional connecting structure, the electrical insulation of the connecting portion is maintained by a compressive adhesion of the plug cap to the ignition plug insulator by elasticity of the rubber of the plug cap. Lately, however, along with the rise in the compression ratio of the engine or the trend of making turbo engines, the ignition voltage is inclined to be set at higher values, which demands a securer electrical insulation at the connecting portion. Accordingly, a reduction in the dielectric strength due to degradation of the sealing property of the ignition plug is becoming a serious concern. Such decrease in the sealing property of the ignition plug is considered to be caused by the reduction in the elasticity of rubber due to thermal aging of the plug cap, creeping, or a deterioration of the rubber surface.

SUMMARY OF THE INVENTION

An object of the present invention is to provide a connecting structure for a high voltage resistance wire which is capable of preventing a reduction in the dielectric strength of the connecting section even in the event of a deterioration in the rubber property of the elastic cap such as the plug cap.

Another object of the present invention is to provide a connecting structure for a high voltage resistance wire which is capable of enhancing the sealing property of the connecting portion.

In order to achieve the above objects, a connecting structure for a high voltage resistance wire according to the present invention comprises, a high voltage resistance wire for suppressing noise which has on one end a connecting terminal which can be fitted to a high voltage terminal that has a cylindrical insulator on its circumference;

an insulating soft elastic cap attached to the high voltage resistance wire surrounding the connecting terminal, which is fited to the cylindrical insulator under the state in which the connecting terminal is fitted to the high voltage terminal; and a rigid holder inserted on the outside of the elastic cap, which may be fitted closely to the outer periphery of the connecting portion of the elastic cap and the cylindrical insulator.

BRIEF DESCRIPTION OF THE DRAWINGS

These and other objects, features and advantages of the present invention will be more apparent from the following description of the preferred embodiments in conjunction with the accompanying drawing in which.

DESCRIPTION OF THE PREFERRED EMBODIMENTS

Figure 1:
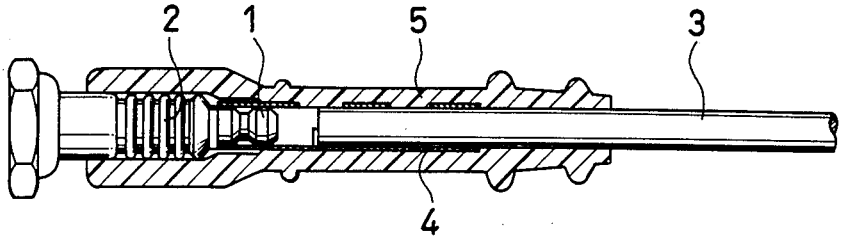
FIG. 1 PRIOR ART
FIG. 1 is a sectional view of a connecting structure for a high voltage resistance wire in accordance with the prior art.
Figure 2:
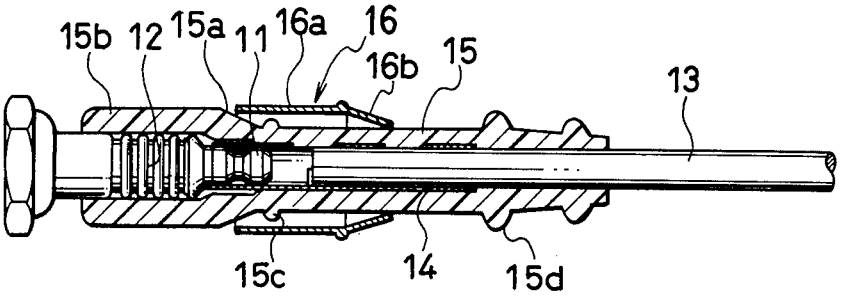
FIG. 2 is a sectional view of an embodiment of the connecting structure for a high voltage resistance wire in accordance with the present invention.

FIG. 2 shows an embodiment of the connecting structure for high voltage resistance wire in accordance with the present invention. In the figure, reference numeral 11 is a high voltage terminal of an ignition plug, 12 is an insulator of the ignition plug as a cylindrical insulator, 13 is a high voltage resistance wire for suppressing noise, 14 is a connector terminal which is secured to one end of the high voltage resistance wire for suppressing noise, and 15 is a plug cap taking the form of an insulating soft elastic cap which is attached to and which surrounds the wire 13 and terminal 14. These components are nearly identical to those of the prior art shown in FIG. 1.

Plug cap 15 is formed with an approximately cylindrical elastic insulating material such as rubber. Its ignition plug side constitutes an integrally formed coupling section **15*b* with larger thickness compared with other sections of plug cap 15, and is connected to the other portions of plug cap 15 via tapered guiding surface 15*a*. On the opposite side of the coupling section 15*b* of the plug cap 15, there are attached a wire 13 and a connector terminal 14 that is attached to the end of the wire 13. The plug cap 15 is constructed in such a way as to permit a linkage of the connector terminal 14, at the approximate mid-section of the plug cap 15, to the high voltage terminal 12 of the ignition plug. On the other hand, on the side of the coupling section of the plug cap 15, the plug insulator 12 of the ignition plug is mounted, and its high voltage terminal 11 is linked to the connector terminal 14 in the plug cap 15, so as to seal the external periphery of the plug insulator 12 with the coupling section 15***b* of the plug cap 15. In addition, on the external periphery of the wire side of the plug cap 15, there are provided projections 15*c* and 15*d*, the use of which will be described later.

On the plug cap 15, a cylindrical holder 16 is inserted so as to be free to move in the direction of the axis of the plug cap 15. The holder 16 is constructed, in a form so as to be closely fitted to the exterior of the coupling section 15*b* of the plug cap 15, and comprises a cylindrical section 16*a* that corresponds to the coupling section 15*b* and a tapered section 16*b* that corresponds to the tapered guiding surface 15*a*. The inner diameter of the cylindrical section 16*a* is slightly smaller than the outer diameter of the coupling section 15*b*, and the aperture of the tip of the tapered section 16*b* is formed to be arrested by the projection 15*c* to prevent holder 16 from falling off plug cap 15. The holder 16 is made of a hard synthetic resin or the like that has rigidity, and its inner surface is given a smooth finish. Reference numeral 16*c* is a slit that is provided on the tapered section 16*b* of the holder 16, and when the holder 16 is moved from the wire side to the coupling section of the plug cap 15, the construction of the tapered section allows the holder 16 to be bent easily by the slit so that it can readily ride over the projection 15*c*.

In the connecting structure in accordance with the present invention, the plug cap 15 is formed with smooth surface, preferably by a material that has self-lubricating property, for instance, an oil-containing synthetic rubber that contains silicon oil or the like. If the external surface of the plug cap does not have a self-lubricating property, a lubricant such as silicon grease may be spread on the outer surface of the plug cap 15 or the inner surface of the holder 16. In doing so, it is preferred to select a lubricant with the quality that will not deteriorate the properties of the holder and that permits an easy detachment, without sticking to the rubber even after long use.

Figure 3:
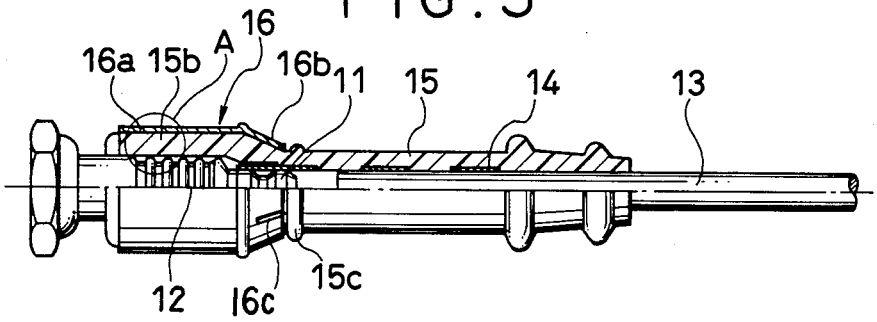
FIG. 3 is a partially cutaway sectional view of the completed state of connection in accordance with the invention.
Figure 4:
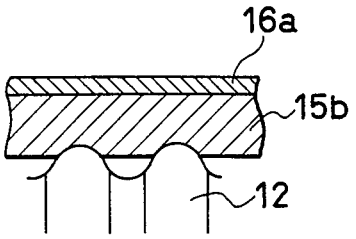
FIG. 4 is an enlarged sectional view taken along line "A" of FIG. 3, illustrating the state of pressurized adhesion of the cylindrical insulator and the elastic cap in accordance with the invention.

In connecting a high voltage resistance wire of the present invention to the ignition plug, a parting agent or the like is spread over the ignition plug insulator 12, as for the existing structure, and the plug cap 15 is pressure-fitted to the insulator 12. In this case, the plug cap 15 is forced to be opened slightly by the plug insulator 12, and the inner surface of the plug cap 15 encroaches closely upon the folds on the outer surface of the plug insulator 12, under the action of the stresses that are generated in the plug cap 15. Moreover, when the holder 16 is fitted by moving it to the outside of the coupling section 15*b* of the plug cap 15, the plug cap 15 is compressed further from the outside by the hadder 16, to be attached under pressure more snugly to the outer surface of the plug insulator 12. An end of the tapered section 16*b* of the holder 16 is arrested by the projection 15*c* of the plug cap 15, and is held under a state of tension from which it is not easy for the holder 16 to fall off (As shown in FIG. 3). This state of tension beteen the ignition plug 15 and the plug insulator 12 as shown in FIG. 4 as an enlargement of the portion A of FIG. 3.

Figure 5:
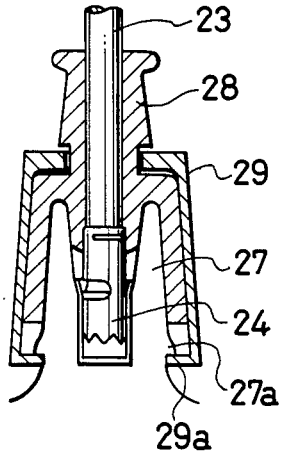
FIG. 5 is a sectional view for another embodiment of the connecting structure in accordance with the present invention.

An additional embodiment, applying the connecting structure for the high voltage resistance wire of the present invention to the tower section of an ignition coil, instead of to the ignition plug, is shown in FIG. 5. in the figure, 23 is a high voltage resistance wire for suppressing noise, 24 is a connector terminal, 27 is an insulating tower, 27*a* is a projection, 28 is a coil cap, 29 is a holder, and 29*a* is a hooking pawl. In this example, tight contact is enhanced by attaching the coil cap 28 under pressure from the holder 29 to the insulating tower 27, and the coil cap 28 is prevented from falling off by the hooking of the hooking pawl 29*a* to the projection 27*a*.

Figure 6:
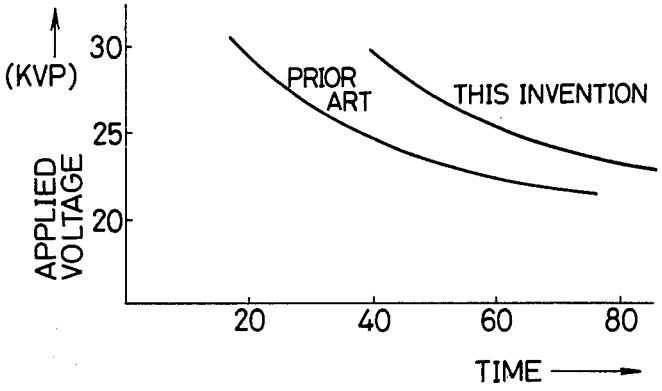
FIG. 6 is a graph illustrating the insulation characteristics of the connecting structure for a high voltage resistance wire in accordance with the present invention.

An ignition plug connecting section that is equipped with a connecting structure of the present invention was constructed for use in experiments. The result of an experiment on the relation between the soaking time and the dielectric strength obtained by soaking the connecting part alone in salt water and applying a high voltage, is shown in FIG. 6. From the result, it will be seen that, compared with the connecting structure of the prior art that does not use the holder, the connecting structure in accordance with the present invention has markedly improved dielectric strength characteristics.

In the connecting structure for high voltage resistance wire of the present invention, it becomes possible to attach the elastic cap to the insulator under pressure from the exterior so that the sealing of the insulating section can be improved and the deterioration in the insulation property can be suppressed to a small extent even when there exists an aging of the elastic cap due to heat or the like. Therefore, the connecting structure according to the present invention makes it possible to retain excellent insulation characteristics.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A connecting structure for high voltage resistance wire, comprising:

a high voltage resistance wire for suppressing noise which has on one end a connecting terminal fitted to a high voltage terminal that has a cylindrical insulator on its circumference;

an insulating soft elastic cap mounted on said high voltage resistance wire enclosing said connecting terminal which is fitted to said high voltage terminal, said cap further being fitted to the cylindrical insulator of the high voltage terminal; and a rigid holder having means for increasing fitting strength of said cap to the cylindrical insulator and sealing efficiency between said cap and insulator, said holder being inserted onto the outside of said elastic cap from the side of the resistance wire toward the side of the cylindrical insulator, which can be fitted closely to the outer periphery of the connecting portion of the elastic cap and the cylindrical insulator.

2. A connecting structure for high voltage resistance wire as set forth in claim 1, wherein said holder is inserted freely movably to said elastic cap.

3. A connecting structure for high voltage resistance wire as set forth in claim 2, wherein said elastic cap has a coupling section on the side of the connecting portion, which coupling section is constructed via a tapered guiding surface to have an increased diameter compared to other sections of the elastic cap.

4. A connecting structure for high voltage resistance wire as set forth in claim 3, wherein said holder comprises a cylindrical section with diameter slightly smaller than that of the enlarged diameter of the coupling portion of said elastic cap and said holder has a tapered section that corresponds to the tapered guiding surface of said elastic cap.

5. A connecting structure for high voltage resistance wire as set forth in claim 4, further comprising a projection adjacent the coupling section along the circumference of said elastic cap, for retention of the holder on the coupling section of the cap.

6. A connecting structure for high voltage resistance wire as set forth in claim 5, wherein at a least one slit is provided in the tapered section of said holder.

7. A connecting structure for high voltage resistance wire as set forth in claim 6, wherein said elastic cap is formed from a material that has self-lubricating property such as an oil-containing synthetic rubber.

8. A connecting structure for high voltage resistance wire as set forth in claim 7, wherein said elastic cap is formed from an oil-containing synthetic rubber that contains silicon oil.

9. A connecting structure for high voltage resistance wire as set forth in claim 6, wherein one of the outer surface of said plug cap and the inner surface of said holder is coated with a lubricant.

10. A connecting structure for high voltage resistance wire as set forth in claim 9, wherein silicon grease is used as the lubricant.

11. A connecting structure for high voltage resistance wire, comprising:

a high voltage resistance wire for suppressing noise which has on one end a connecting terminal fitted to a high voltage terminal that has a cylindrical insulator on its circumference;

an insulating soft elastic cap mounted on said high voltage resistance wire enclosing said connecting terminal which is fitted to said high voltage terminal, said cap further being fitted to the cylindrical insulator of the high voltage terminal; and a rigid holder inserted onto the outside of said elastic cap, which can be fitted closely to the outer periphery of the connecting portion of the elastic cap and the cylindrical insulator;

wherein said holder is inserted freely movably to said elastic cap;

wherein said elastic cap has a coupling section on the side of the connection portion, which coupling section is constructed via a tapered guiding surface to have an increased diameter compared to other sections of the elastic cap;

wherein said holder comprises a cylindrical section with diameter slightly smaller than that of the enlarged diameter slightly smaller than that of the coupling portion of said elastic cap and said holder has a tapered section that corresponds to the tapered guiding surface of said elastic cap;

further comprising a projection for preventing the fall-off of the holder provided in the area of the elastic cap other than that adjacent the coupling section along the circumference of said elastic cap, for retention of the holder on the coupling section of the cap; and wherein at least one slit is provided in the tapered section of said holder.

12. A connecting structure for high voltage resistance wire as set forth in claim 11, wherein said elastic cap is formed from a material that has self-lubricating property such as an oil-containing synthetic rubber.

13. A connecting structure for high voltage resistance wire as set forth in claim 12, wherein said elastic cap is formed from an oil-containing synthetic rubber that contains silicon oil.

14. A connecting structure for high voltage resistance wire as set forth in claim 13, wherein one of the outer surface of said plug cap and the inner surface of said holder is coated with a lubricant.

15. A connecting structure for high voltage resistance wire as set forth in claim 14, wherein silicon grease is used as the lubricant.

* * * * *